United States Patent [19]

Schuller

[11] 4,207,020

[45] Jun. 10, 1980

[54] HOPPER CAR DOOR LATCHING ARRANGMENT

[75] Inventor: James J. Schuller, Crete, Ill.

[73] Assignee: Pullman Incorporated, Chicago, Ill.

[21] Appl. No.: 896,652

[22] Filed: Apr. 17, 1978

[51] Int. Cl.[2] ..... B61D 7/18; B61D 7/30; B65G 67/24

[52] U.S. Cl. ..... 414/378; 105/241.2; 105/250; 105/308 P; 105/310

[58] Field of Search ..... 105/241 C, 250, 253, 105/308 P, 308 R, 310; 414/377, 378

[56] References Cited

U.S. PATENT DOCUMENTS

| | | | |
|---|---|---|---|
| 1,266,630 | 5/1918 | Ross et al. | 105/241 C |
| 1,847,516 | 3/1932 | Knepper | 105/308 R |
| 1,851,695 | 3/1932 | Dendler | 105/253 |
| 3,121,405 | 2/1964 | Smith | 105/308 P |
| 3,786,764 | 1/1974 | Beers, Jr. et al. | 105/250 X |
| 4,046,268 | 9/1977 | Adler | 105/241 C |

*Primary Examiner*—Howard Beltran
*Attorney, Agent, or Firm*—Richard J. Myers

[57] ABSTRACT

An open top railway hopper car is provided with longitudinal center dump discharge openings closed by hinged clam shell type of doors. The doors include an arm and linkage arrangement pivoted to the hopper car structure for continually urging the doors to a closed position. The arm and linkage arrangement is opened by means of side of track cams. Locking for each of the doors is provided by means of a locking pawl engaging stops provided on door brackets which preclude opening of the doors during transport. Opening actuation of the arm and linkage arrangement provides for initial displacement of the locking pawls thereby permitting the doors to continue to their open position.

10 Claims, 7 Drawing Figures

HOPPER CAR DOOR LATCHING ARRANGMENT

BACKGROUND OF THE INVENTION

1. Field of the Invention

The present invention relates to open top hopper cars primarily utilized for carrying cargo such as coal and the like and more specifically pertains to a center dump railway car which includes clam shell type closure doors.

2. Description of the Prior Art

Patents pertinent to the present invention are:

U.S. Pat. No. 1,847,516 is cited for its disclosure of a pawl safety latch arrangement for railway car doors, U.S. Pat. No. 1,851,695 is cited for its disclosure of a releasable locking element for the drop bottom door of a railway car, U.S. Pat. No. 3,121,405 is cited for its disclosure of a hopper car door locking arrangement, and U.S. Pat. No. 3,786,764 is cited for its disclosure of a door actuating assembly for a rapid commodity discharge railway car. The present invention is an improvement over the aforementioned patents.

SUMMARY OF THE INVENTION

The present invention pertains to an open top hopper car having a lower central discharge opening for discharging material vertically downwardly through the bottom of the car. Railway cars of this type are generally utilized for the transport of materials such as coal or the like and include clam shell door arrangements which are pivotally mounted at their upper ends on hangers with the doors swinging horizontally outwardly in opposite directions to opposite sides of the discharge opening whereupon the load may be dumped. In the present arrangement doors of this type are utilized and these are opened by means of track side cam or actuating mechanisms which are operative as the railway car approaches the discharge stations along the track. The cams are situated so as the railway car moves along the track they will be engaged by a suitable cam suspended by means of an arm from pivot brackets disposed on opposite sides of the car. The arms are thus pulled outwardly and these being in turn connected to links which are pivotedly connected to the doors function to swing the doors in the outward direction to open them. Closure cams beyond the discharge site are positioned adjacent to the track and are engaged by the rollers and arms and are thus in a manner inwardly urging the doors to the closed position. In the present invention an improved locking device is provided which will effectively lock the doors in the closed position during movement of the car between its destinations. The present lock includes a pair of latches or pawls which are hingedly mounted on the hopper structure on opposite sides of the discharge opening. The pawls are effective to engage keeper notches on brackets which in turn are supported on outer opposite edges of each of the doors. In this position the pawls lock the doors against outward movement. Each of the aforementioned brackets which contain the stops or keeper seats also is providied with a pivot pin which engages a slot provided in one end of the link, each of which is also attached in pivotal relation to one of the aforementioned arms. At the ends of the links where they are attached to the brackets, a lost motion connection is provided with respect to the pivot pins supported on the bracket. Each link also has at this end an upwardly projecting finger or actuating element which is positioned to engage and move upwardly the pawl or latch element out of the stop or lock position as the link is moved outwardly in response to outward movement of the arm when it engages the associated opening cam. Thus the finger or actuating element is moved upwardly by virtue of the lost motion connection during the initial movement of the arm outwardly. Thereafter, with the pawl disengaged from the stop or keeper seat, continued movement of the car along the track provides for the further outward movement of the arms and links, thereby moving the doors to their open position. The closure of the doors is effected by the weight of the doors and assured by the trackside closure cam arrangement which moves the doors inwardly to the closed position.

DESCRIPTION OF THE PREFERRED EMBODIMENT

Figure 1:
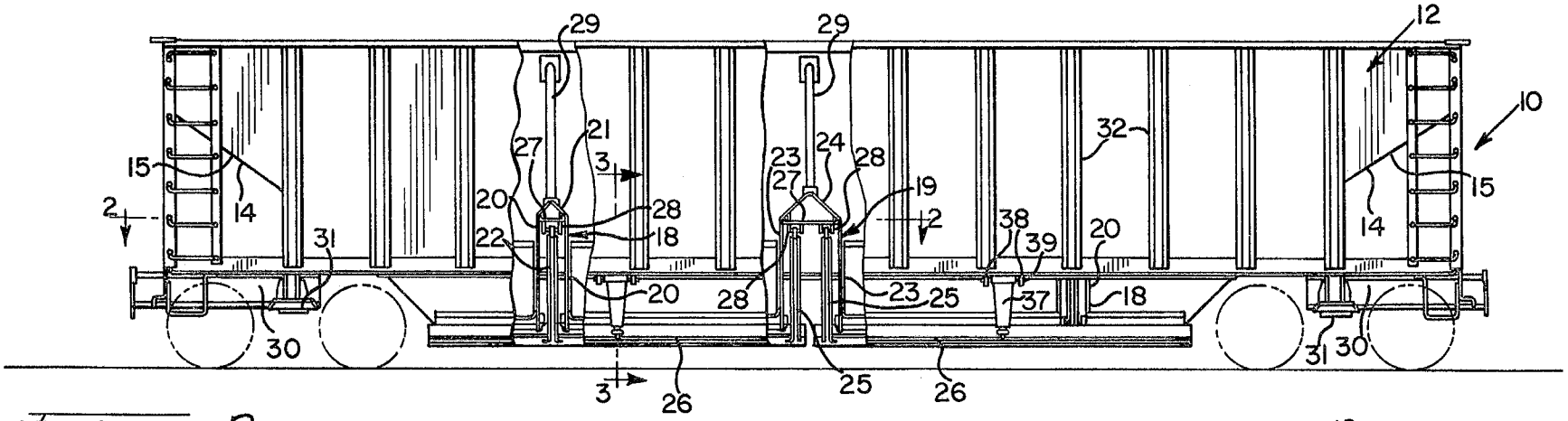
FIG. 1 is a side elevational view, partially in section of an open top railway hopper car embodying the invention.
Figure 2:
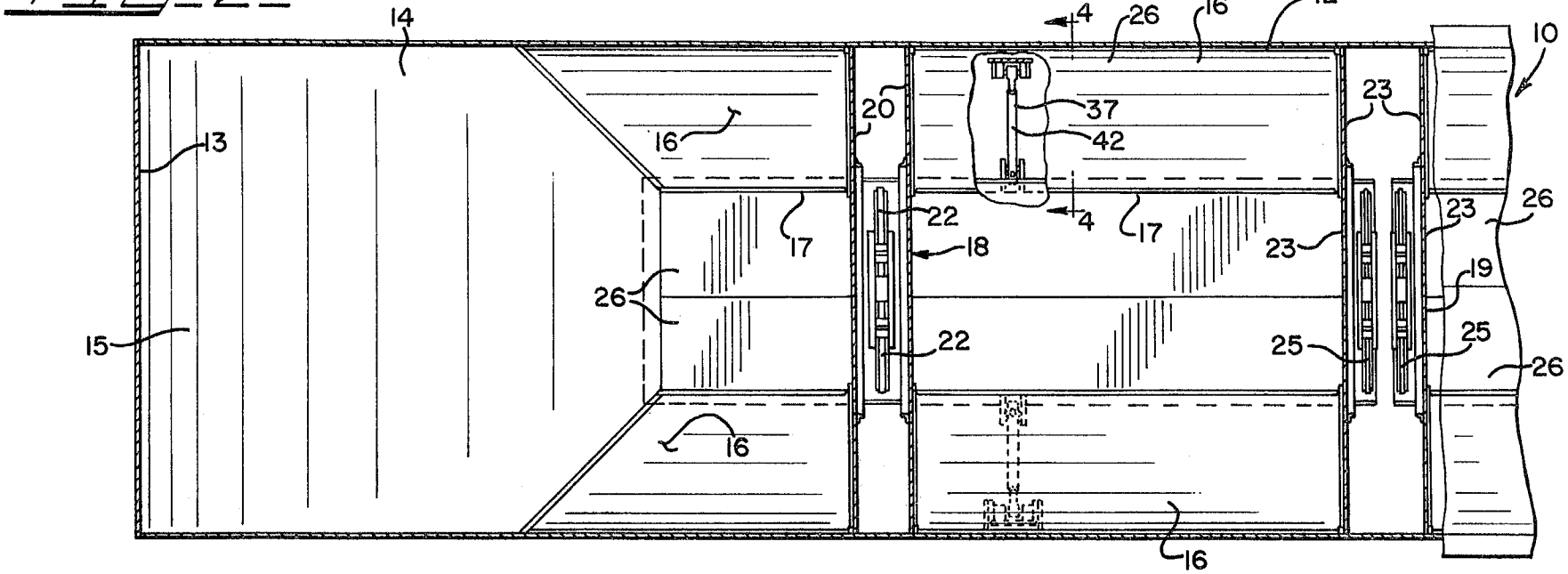
FIG. 2 is an enlarged cross-sectional view taken substantially along the line 2—2 of FIG. 1.
Figure 3:
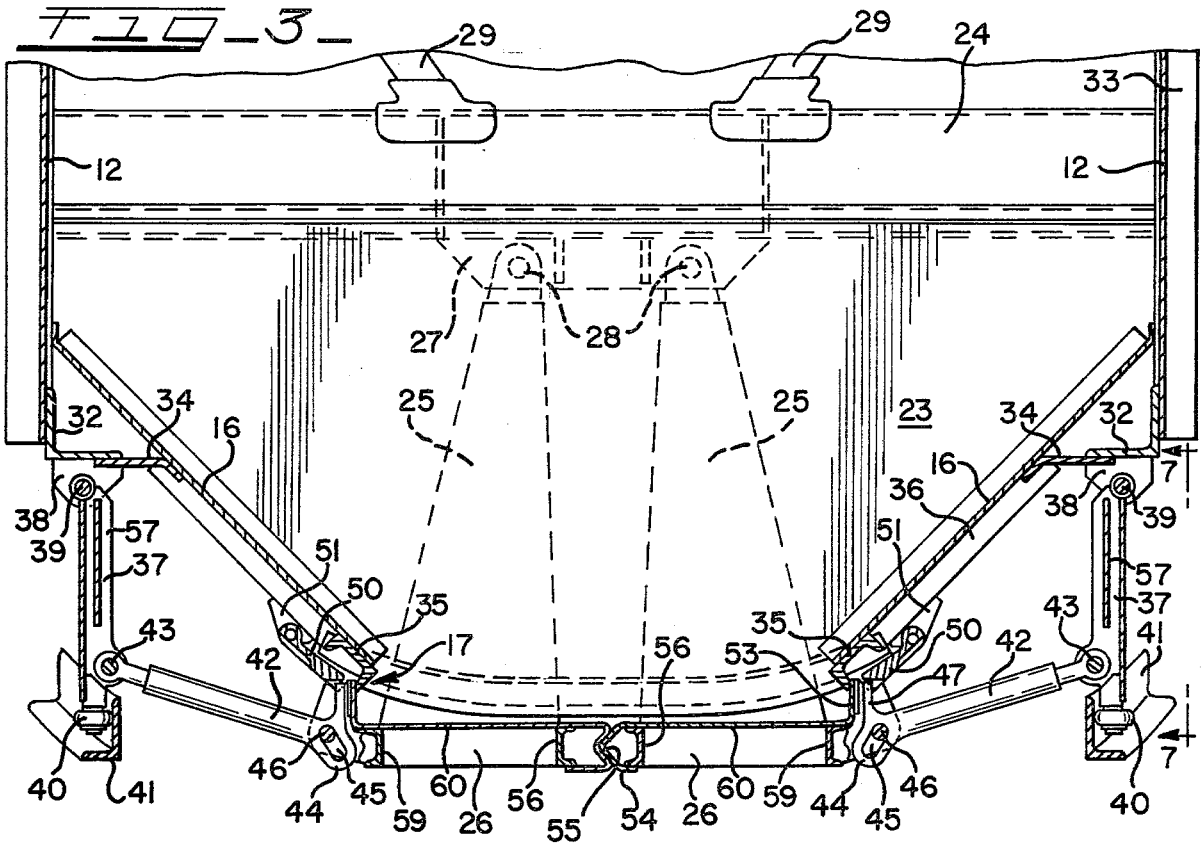
FIG. 3 is a cross-sectional view through the open top hopper car taken substantially along the line 3—3 of FIG. 1.

FIG. 1 discloses an open top railway hopper car 10 including a car body provided with side walls 12 and end walls 13. The car includes a pair of hoppers 14 longitudinally spaced which are formed by end slope sheets 15 and side slope sheets 16. Each of the hoppers 14 is provided with a downward vertical discharge opening 17. The car includes a pair of longitudinally spaced hanged housings 18 between which the central hanger housing 19 is supported. The hanger housings 18 are formed by longitudinally spaced vertical walls 20 extending upwardly into the car and include top caps 21. The hanger housing 19 is formed by means of vertical spaced walls 23 and include a top cap 24. Each of the hanger housings 18 also include hangers 22 which are supported on hinge brackets 27. The housing 19 also supports hangers 25 which are also hingedly supported by the hinge brackets 27 contained therein. As best shown in FIG. 3 hangers 25 are hinged by means of hinge pins 28. The housings 18 and 19 are also connected to the sides of the car by means of diagonal braces 29.

The present hopper car 10 is of the sill-less type and includes at opposite ends thereof stub sills 30 which support car bolsters 31 on conventional car trucks. The railway hopper car 10 further includes side sills 32 which support outside vertical posts 33. Brackets 34 connect the sills 32 to the side slope sheets 16. The lower ends of the slope sheets 16 have connected thereto longitudinally extending channels 35 which by means of diagonal channels 36 connected to the slope sheets 16 are tied into the side-sills 32 by means of the brackets 34.

Figure 4:
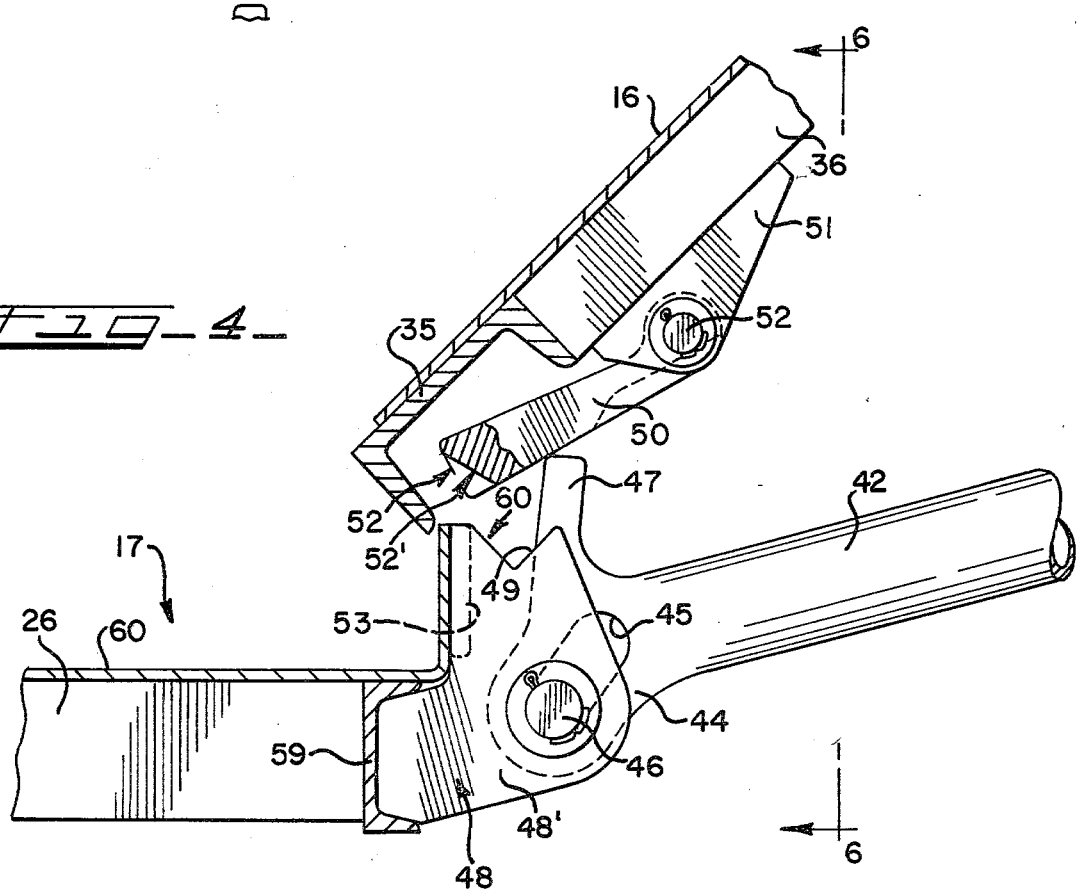
FIG. 4 is a cross-sectional view taken substantially along the line 4—4 of FIG. 2.
Figure 5:
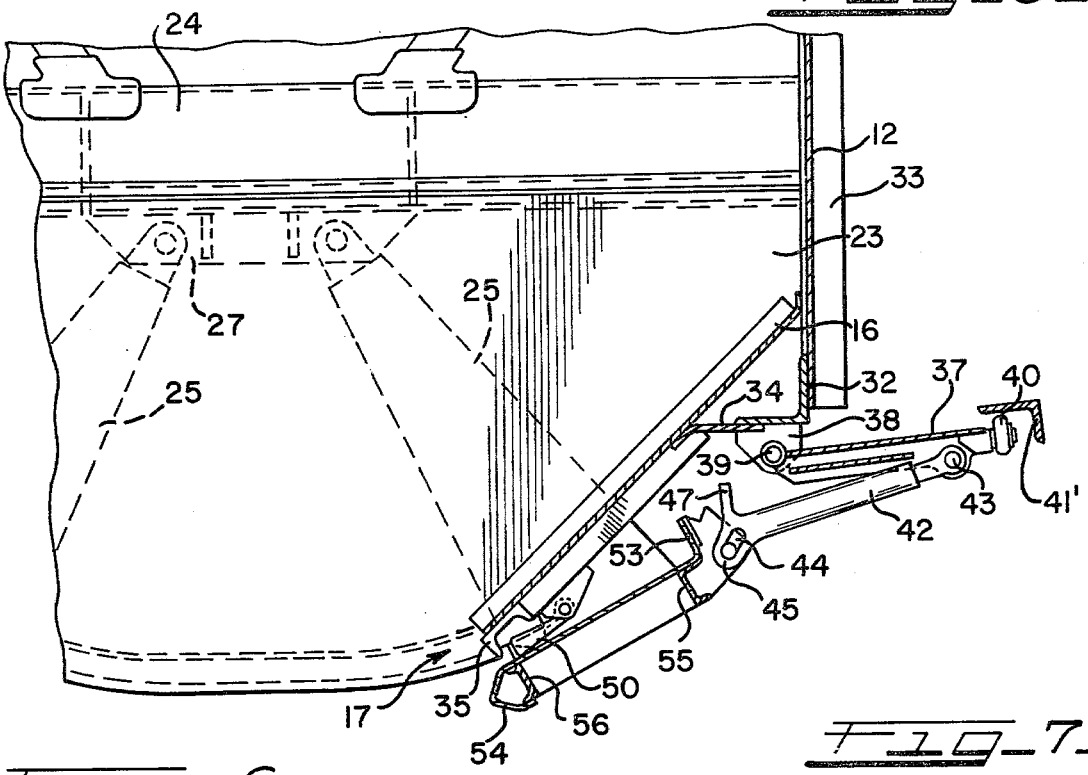
FIG. 5 is a view similar to FIG. 3 showing the open position of a clam shell door arrangement.
Figure 6:
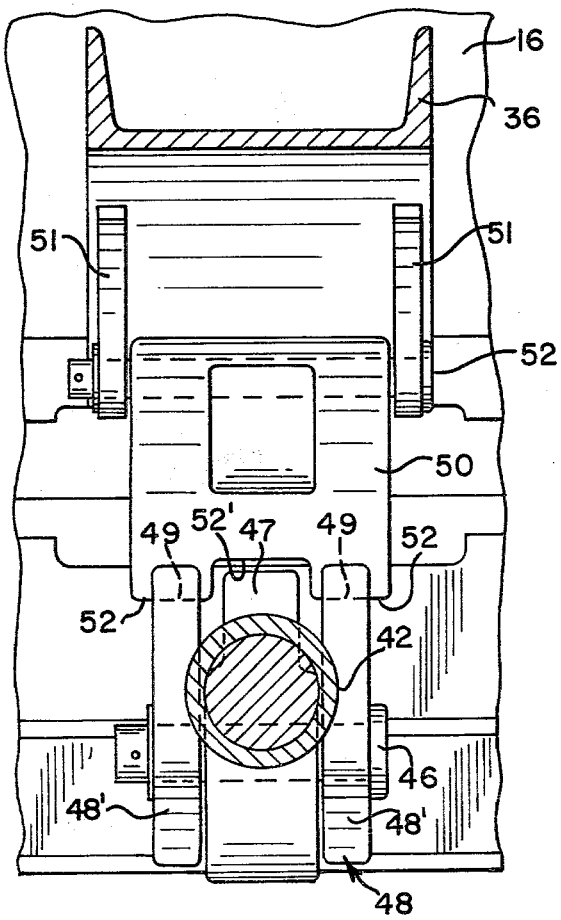
FIG. 6 is a cross-sectional view taken substantially along the line 6—6 of FIG. 4.
Figure 7:
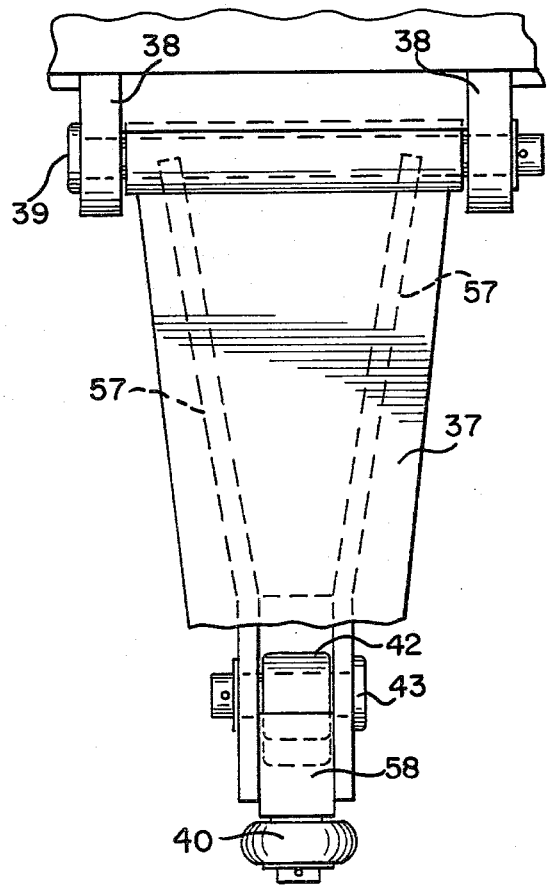
FIG. 7 is a side elevational view taken substantially along the line 7—7 of FIG. 3.

The hangers 22 and 25 are connected at their lower ends to clam shell type doors 26 which are hingedly moved on the hinge brackets 27 between open and closed positions as best shown in FIGS. 3 and 5, it being particularly noted that because of the location of the hinge pins 28 relative to the doors 26, the doors will close and stay closed by their own weight as well as that of lading within the car. To accommodate movement of the doors to the open position, vertical arms 37 are provided which are pivotedly supported on brackets 38 by means of pivot pins 39, said brackets 38 being supported on the lower surfaces of the side-sills 32. Each of the arms 37 is provided at its lower end with a cam wheel 40 adapted to engage track side cams 41 and 41' to provide for opening and closing of the clam shell doors 26. Each arm 37 is pivotedly connected to a link 42 extending inwardly connected to the arms 37 by means of pivot pins 43. The links 42 at their inner ends are provided with projections 44 having disposed therein elongated slots 45 and upward projecting actuating fingers 47. Pivot pins 46 are connected to brackets 48, these in turn being rigidly supported on the outer channels 55 of the doors 26. The pivot pins 46 extend through the slots 45 and thus these portions of the links 42 have relative lost motion and hinging connections with respect to the brackets 48. The brackets 48 are further supported on the doors 26 by a vertical flange 59 having thereon between the bracket sides a spacer pad 53. As best shown in FIG. 6 the bracket 48 comprises a pair of laterally spaced plate portions 48'. The actuating finger 47 is disposed between the bracket plates 48'. The upper ends of the bracket plates 48' are provided with undercut portions to provide stops or keeper seats 49 which are adapted to be engaged in locking relation with a pawl 50 hingedly supported on a bracket 51 by means of a pivot pin 52, the bracket 51 being connected to the underneath side of the channel brace 36. As best shown in FIG. 4 the end of the latch or pawl 50 is provided with an engaging face 52 which is adapted to engage sides of the stop 60 or bracket plates 48' to securely lock the doors 26 in the closed position as shown in FIG. 3. In the said closed position the doors have their tongues 54 in engagement with a groove member 55 provided in the other door so as to provide a completely and effectively sealed construction. Each of the doors also includes longitudinal channel supports 56 adjacent to the tongue and groove arrangement and includes outer channels 55 which support the door plates 60. As best shown in FIG. 7 the arm 37 also includes spacer straps 57 which are rigidly connected at their lower ends to support block 58. In turn support block 58 pivotably supports the cam wheel 40 of each of the arms.

Operation

FIG. 3 discloses the closed position of the doors just prior to opening, the cam wheels 40 being in engagement with the track side opening cam 41. As the car moves along the cam, the arm 37 is moved hingedly outwardly thus exerting an outward force on the links 42 which initially provide for sliding movement of the pivot pin 46 in the slot 45. As the link slides with relation to the pin 46 the actuating finger 47 moves upwardly and outwardly and into engagement with the undercut surface 52' of the pawl 50, in turn lifting the pawl 50 to the position indicated in FIG. 4. As the pawl is dislodged from the stop 49 continued movement of the link 42 outwardly moves the clam shell door outwardly to the open position. When this occurs of course the load is dumped down through the discharge opening and the cars emptied. As the car progresses further along the track another track side cam 41' as best shown in FIG. 5 is engaged and a downward force exerted on the arm 37 either by gravity or due to the action of the cam 41'. The doors move to their closed position whereupon the pawl 50 again is engaged against the stop 49 and the doors are again in their locked position. The under cut stop or keeper seat 49 is as indicated a V-shaped design and as long as the pawl is within the V-shaped groove it is impossible to open the door at any time except at the end loading site when the door unloading operation is performed. The first several degrees of swinging of the actuator arm 37 do not pull on the door but merely raise the pawl out of its engaging position whereupon continued movement then causes the door to move to its open position. The type of clam shell door indicated generally returns to its closed position by gravity by virtue of the linkage arrangement disclosed wherein the arm 37 naturally by gravity is forced downwardly from the position shown in FIG. 5. If desired, however, the door closure cam 41' may be designed to exert a downward push on the arm to effectuate power closure in addition to the gravity.

What is claimed is:

1. In a railway car having a body including a hopper structure provided with a bottom discharge opening;
   - a door arrangement for said opening including a pair of doors positioned in a closed position in contiguous side by side relation beneath said opening,
   - means hingedly supporting said doors on said body for relative movement laterally outwardly to opposite sides of said opening, the improvement of a door actuating mechanism for each door each comprising:
   - an arm pivotally supported on said hopper laterally outwardly of each said door,
   - cam engageable means on said arm,
   - a link pivotally connected to said arm and to each said door,
   - said link during engagement of said cam engaging means with a track side cam exerting an outward pulling force on each door to move the same from a closed to an open position,
   - a keeper member mounted directly on each of said doors,
   - a latch member mounted on said hopper structure and engageable with said keeper member in the closed position of each door for locking the same against outward movement, and
   - actuating means on said link and operative during the initial outward pulling movement of said link to engage said latch and disengage the same from said keeper member, thereby permitting each of said doors to move to an open position.

2. The invention in accordance with claim 1, wherein said cam engageable means comprises a roller.

3. The improvement in accordance with claim 1, wherein
   - said doors are of a clam sheel construction including vertical hanger arms supporting opposite ends of said door hingedly on said hopper structure.

4. The invention in accordance with claim 3, wherein said hanger arms in the closed position of said doors extend substantially vertically and in the open position of said doors are disposed substantially horizontally.

5. The invention in accordance with claim 1, wherein said latch comprises a pawl pivotally connected to said hopper structure above said door, and said keeper includes a pawl engageable stop member connected to one side of said door for engagement with said pawl.

6. The invention in accordance with claim 5, wherein said actuating means comprises a finger on said link.

7. The invention in accordance with claim 5, wherein said actuating means includes a projection on said link engaging said pawl to move the same upwardly out of engagement with said stop member.

8. The invention in accordance with claim 7, wherein said link includes first means pivotally connecting one end thereof to said arm, and second means pivotally connecting the other end to said door.

9. The invention in accordance with claim 8, wherein said second means includes a lost motion connection.

10. The invention in accordance with claim 9, wherein said lost motion connection comprises a slot in said link, and a pivot member slideable in said slot and supported on said door.

* * * * *